United States Patent [19]

Grohoski et al.

[11] Patent Number: 4,573,267

[45] Date of Patent: Mar. 4, 1986

[54] HAIRCUTTING DEVICE

[76] Inventors: Jane L. Grohoski, P.O. Box 325, Swamp Picnic Rd.; Diane L. Marinari, 458 Kleman Rd., both of Gilbertsville, Pa. 19525

[21] Appl. No.: 590,024

[22] Filed: Mar. 15, 1984

[51] Int. Cl.[4] ..... B26B 19/44

[52] U.S. Cl. ..... 30/133

[58] Field of Search ..... 30/133, 131, 124, 201

[56] References Cited

U.S. PATENT DOCUMENTS

| | | | |
|---|---|---|---|
| 2,523,201 | 9/1950 | Ellis | 30/133 X |
| 3,279,023 | 10/1966 | Zobel | 30/133 X |
| 3,900,949 | 8/1975 | Anzalone | 30/133 X |
| 4,005,526 | 2/1977 | Clay | 30/133 |
| 4,261,102 | 4/1981 | Andriotis | 30/133 |
| 4,473,945 | 10/1984 | Nagel, Jr. | 30/133 |

FOREIGN PATENT DOCUMENTS

| | | | |
|---|---|---|---|
| 2400414 | 4/1979 | France | 30/133 |

*Primary Examiner*—E. R. Kazenske
*Assistant Examiner*—Willmon Fridie, Jr.
*Attorney, Agent, or Firm*—Harvey B. Jacobson

[57] ABSTRACT

A haircutting device utilizing a vacuum nozzle provided with an inclined intake end utilized as a guide for placement of the scissors and as a cutting guide for determining the length of hair left on the head of the person receiving a haircut with this length being adjustable by an adjustably supported ball type supporting structure movably engaged with the scalp of the person receiving the haircut. The vacuum nozzle is provided with a contour to facilitate the nozzle fitting against the rear surface of the hand with a strap arrangement being provided to secure the nozzle to the hand. In one form of the invention, the vacuum nozzle is associated with a self-contained vacuum motor and fan unit and collecting bag that is either battery powered or powered through a suitable power cord extending to a conventional electrical outlet. In another embodiment of the invention, the vacuum nozzle is in the form of an attachment to a vacuum hose which may be connected to a conventional vacuum cleaner that is floor supported or the like, a permanently installed vacuum system in the wall or ceiling or a vacuum cleaner that is supported by the person using the device such as in the form of a backpack supported by shoulder straps or supported in other manners from the person using the device. The vacuum not only lifts the hair so that it can be accurately cut or trimmed but also removes all of the hair being cut thereby reducing the tendency of hair to fall onto the neck, ears and other areas of the person receiving the haircut, eliminating cut hair on the floor and also enabling the person using the device to more readily proceed with the haircut since all cut hair will be removed from the area.

8 Claims, 6 Drawing Figures

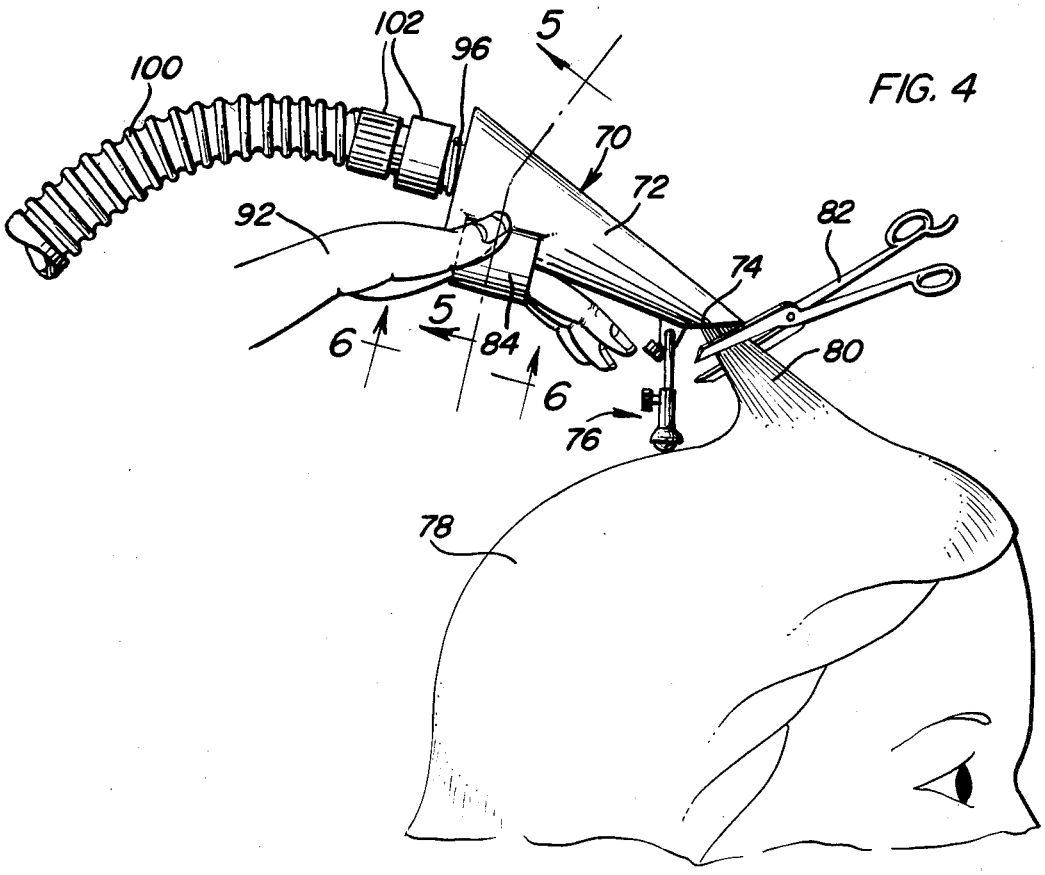
FIG. 4
FIG. 5
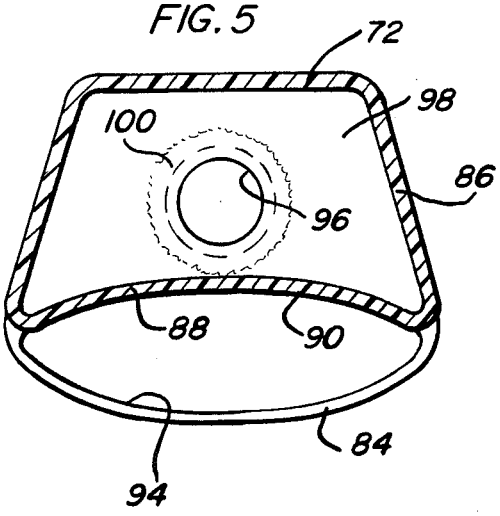
FIG. 6
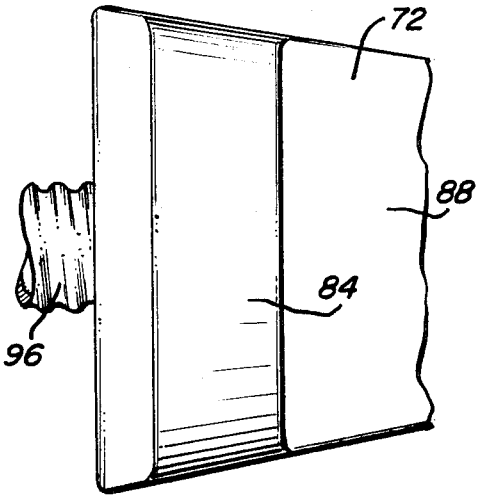

HAIRCUTTING DEVICE

BACKGROUND OF THE INVENTION

1. Field of the Invention

The present invention generally relates to a haircutting device and more specifically a vacuum type of haircutting device that is provided with an adjustable supporting ball assembly engaging the scalp or surface of the head of the person receiving a haircut in order to enable movement of the vacuum device in any direction and in order to vary the spatial relation between the inlet end of the vacuum device and the head of the person receiving a haircut to vary the length of hair left on the head with the vacuum device being constructed to fit onto and be attached to the back surface of the hand which leaves the fingers and thumb of the supporting hand free for other uses.

2. Description of the Prior Art

Various types of haircutting appliances and apparatuses have been provided to enable a barber, hairdresser or the like to more expediently and accurately cut the hair of a person. Such devices include the use of guides to measure the length of hair left on the head and also vacuum devices to remove cut hair and to pull the hair away from the scalp to facilitate the hair being cut to a desired length. The following U.S. patents relate to this field of endeavor: U.S. Pat. Nos. 3,900,949; 4,000,562; 4,097,122; 4,150,483; 4,188,720; 4,216,581; 4,219,931; 4,261,102; 4,313,405; 4,380,870.

While the above listed patents disclose various structures utilizing vacuum and a cutting device, including scissors, to cut hair, they do not disclose the specific structure of this invention.

SUMMARY OF THE INVENTION

An object of the invention is to provide a haircutting device utilizing a vacuum nozzle supported against the back surface of the hand of a person using the device and including a ball type scalp-engaging support to adjustably position the intake on the vacuum nozzle in spaced relation to the surface of the head of the person whose hair is being cut so that scissors may be used in adjacent relation to the intake of the vacuum nozzle which serves as a guide for cutting the hair at a predetermined length.

Another object of the invention is to provide a haircutting device in accordance with the preceding objects in which the ball type roller can be vertically adjusted in relation to the intake end of the nozzle and also adjusted laterally and longitudinally of the vacuum nozzle for optimum positioning of the support in relation to the vacuum nozzle.

A futher object of the invention is to provide a haircutting device in accordance with the preceding objects in which the vacuum motor and fan unit is self-contained within the vacuum nozzle with the components being of lightweight construction and provided with a power source which may be self-contained batteries or an extension cord extending to an electrical outlet.

Still another object of the invention is to provide a haircutting device in which the vacuum nozzle is attached to a vacuum hose that is connected to a conventional vacuum cleaner, a permanently installed wall or ceiling vacuum system or a vacuum cleaner that is supported from the person using the device such as being in the form of a backpack or the like.

A still further object of the invention is to provide a haircutting device which enables a person's hair to be quickly and accurately cut with the vacuum removing the cut hair from the area of the hair being cut thereby maintaining this area in a clean and readily observable condition and avoiding discomfort caused by hair being deposited on the neck, ears and other areas of the person receiving the haircut.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 4 is a side elevational view of another form of the invention in which the vacuum nozzle is connected with a vacuum hose.

FIG. 5 is a vertical, sectional view taken substantially upon a plane passing along section line 5—5 on FIG. 4 illustrating specific structural details of the vacuum nozzle and hand-receiving strap.

FIG. 6 is a bottom plan view of a portion of the vacuum nozzle taken along reference line 6—6 on FIG. 4 illustrating further structural details of the hand strap for supporting the vacuum nozzle on the hand of the user.

DESCRIPTION OF THE PREFERRED EMBODIMENTS

Figure 1:
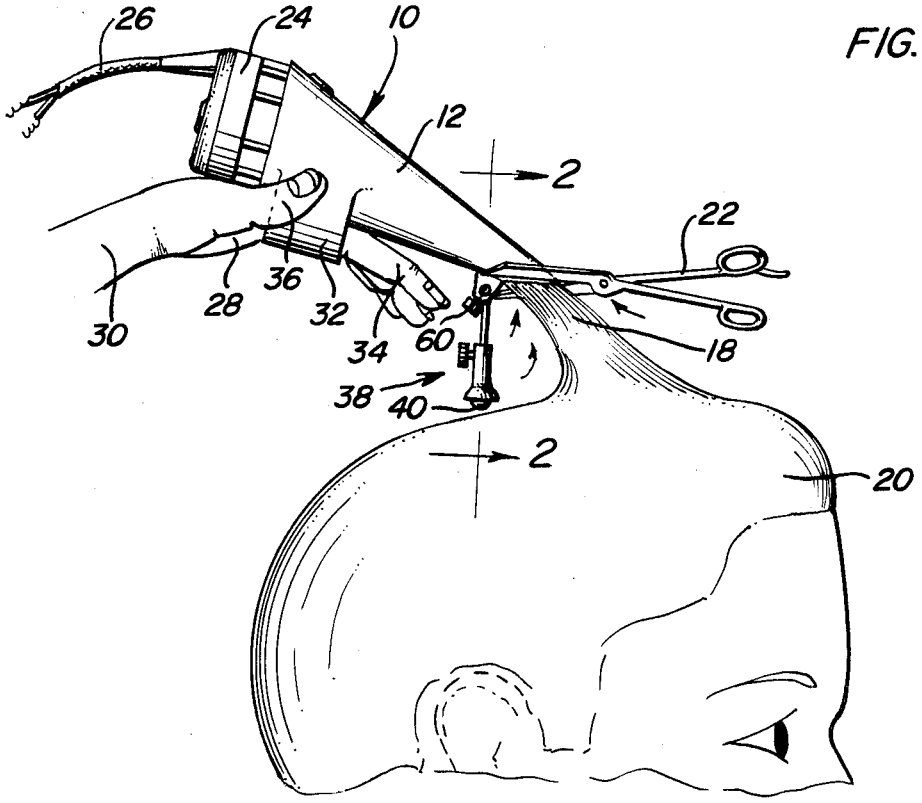
FIG. 1 is a side elevational view of the self-contained form of the haircutting device of the present invention illustrating the manner in which it is used to cut hair.
Figure 2:
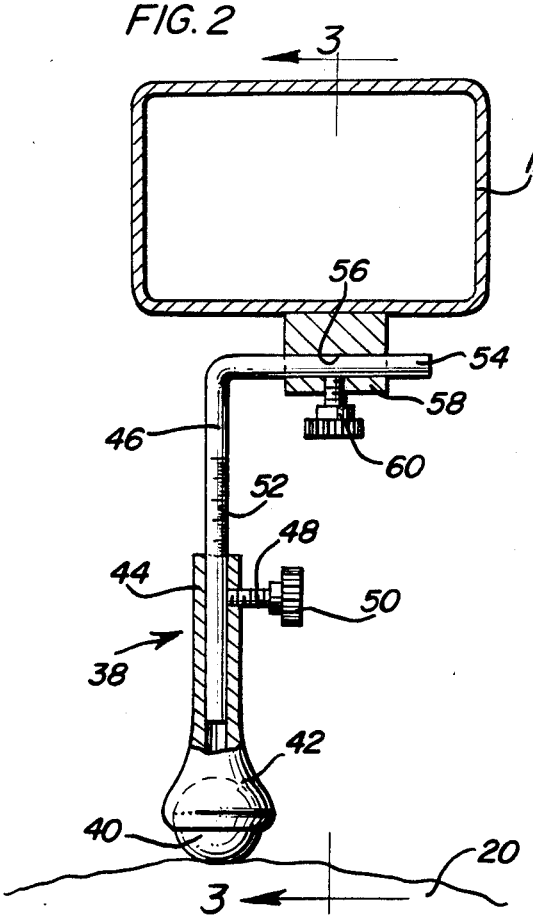
FIG. 2 is a transverse, sectional view, on an enlarged scale, taken substantially upon a plane along section line 2—2 of FIG. 1 illustrating the structural details of the support for the vacuum nozzle and its relationship to the nozzle.
Figure 3:
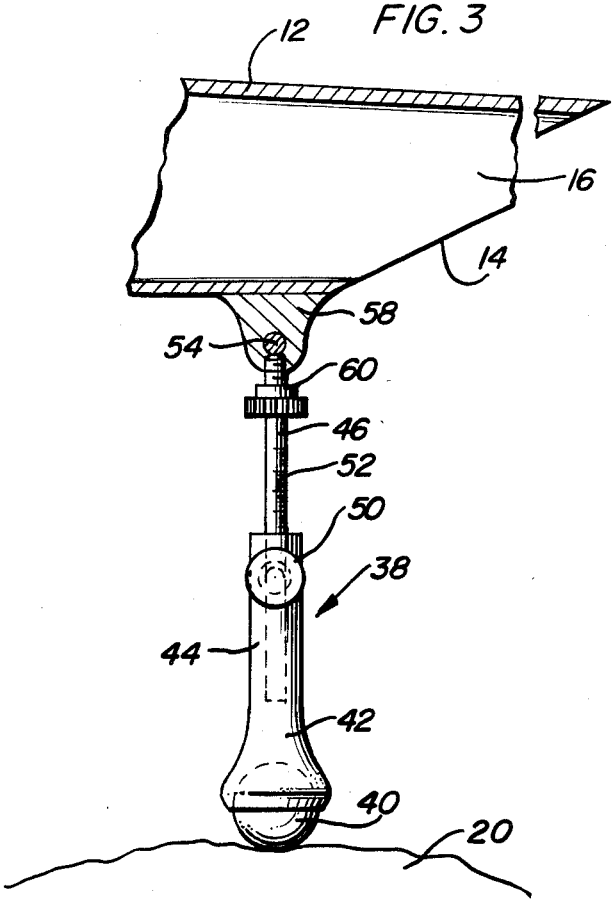
FIG. 3 is a vertical sectional view taken substantially upon a plane passing along section line 3—3 on FIG. 2 illustrating further structural details of the support structure for the vacuum nozzle.

Referring now to FIGS. 1-3 of the drawings, the self-contained embodiment of the haircutting device of the present invention is designated by reference numeral 10 and includes a tapered, hollow vacuum nozzle 12 constructed preferably of transparent plastic material and provided with a generally rectangular cross-sectional configuration and an inclined end edge 14 which forms an intake 16 so that vacuum induced in the nozzle 12 will lift the hair 18 to be cut upwardly from the scalp 20 into the intake 16 so that a pair of scissors 22 can be used to cut the hair 18 with the cut hair being pulled into the nozzle 12. The nozzle 12 is oriented in a position so that the inclined end edge 14 generally parallels the scalp and the inclined end edge 14 may be used as a length guide for the scissors 18 and also a guide for maintaining the scissors 18 generally in parallel relation to the scalp 20. The tapered nozzle 12 includes a motor-fan unit 24 at the large, outer end thereof which is provided with power through a power cord 26 having a male plug on the end thereof for insertion into a conventional electrical outlet. Optionally, the motor-fan unit may be powered by self-contained rechargeable batteries or the like with this unit being maintained of lightweight construction so that the person using the device may support the nozzle 12 and the motor-fan unit from the back of the hand 28 without undue fatigue occurring in the hand 28 or the wrist 30 or other portions of the body of the person using the device. As illustrated, the bottom surface of the tapered nozzle 12 is provided with a loop or hand strap 32 integral with the tapered nozzle 12 across the lower surface thereof so that the hand 28 can be inserted into the strap 32 so that the major portion of the length of the fingers 34 as well as the thumb 36 are free to pivot or move in a normal manner.

The intake end of the nozzle 12 is provided with a supporting structure generally designated by the numeral 38 and which includes a rotatable ball 40 engaging the scalp 20 of the person receiving the haircut. The ball 40 is rotatably mounted in a downwardly opening socket 42 at the lower end of a tubular sleeve or stem 44 which telescopically receives a vertical support rod 46 adjustably secured in the sleeve 44 by a setscrew or lock screw 48 having a knurled knob 50 on the outer end thereof so that by loosening or tightening the screw 48, the sleeve 44 may be telescoped in relation to the rod 46. A graduated scale 52 is provided on the rod 46 for cooperation with the upper end of the sleeve 44 to indicate the height of the inclined edge 14 of intake 16 from the scalp 20 thereby indicating the length of hair left on the scalp. Suitable numerical indicia may be provided on the graduated scale to provide a direct reading of the hair length to be left on the scalp. The upper end of the support rod 46 includes a laterally extending rod 54 that extends through a bore 56 in a depending supporting boss 58 integral with the bottom wall of the hollow vacuum nozzle 12. A lock screw and knurled knob 60 similar to the lock screw 48 and knob 50 is threaded through the boss 58 to lock the rod 54 in adjusted position both laterally of the nozzle and angularly about an axis defined by the rod 54 so that the ball 40 may be positioned adjustably laterally of the hollow nozzle 12 and also in an arcuate manner about an axis defined by the rod 54 thereby enabling adjustment of the ball longitudinally of the nozzle 12 for positioning the nozzle 12 and the intake end thereof in optimum relation to the scalp with the support structure 38 enabling universal or omni-directional movement since the ball 40 may be rotated in any desired direction by exerting force on the tapered nozzle 12.

The vacuum nozzle 12 will have the usually provided collection bag therein and the nozzle can be separated from the motor-fan unit by a suitable latch structure of conventional construction to enable the collection bag to be emptied when desired. The nozzle 12 and the associated motor-fan unit 24 are similar in construction to portable vacuum cleaner devices that are handheld that are now commercially available with the tapered nozzle being modified by providing the support structure 38 and providing the hand strap type of support rather than a cantilever handle at the rear of the motor-fan unit as is used in conventional vacuum cleaners of this type. Also, the tapered nozzle 12 is of transparent construction and the motor-fan unit is of lightweight construction with the power cord enabling lightweight construction by eliminating a rechargeable battery unit. Thus, the entire structure is relatively inexpensive to manufacture and the adjustment capabilities of the support structure 38 are such that the vacuum nozzle 12 may be optimally positioned with respect to the scalp and supports considerable portions of the weight of the haircutting device 10 thereby enabling the haircutting device to be used for relatively long periods of time without undue stress and fatigue of the hand and other areas of the person using the device.

Referring now specifically to FIGS. 4–6 of the drawings, an attachment form of the haircutting device of the present invention is generally designated by reference numeral 70 and includes a tapered, hollow vacuum nozzle 72 having an inclined intake end 74 at one end and a supporting structure 76 adjacent thereto to engage the scalp 78 so that hair 80 will be drawn into and toward the intake 74 so that scissors 82 may be used to cut the hair 12 in the same manner as in the embodiment illustrated in FIGS. 1–3 with the supporting structure 76 being identical thereto. Also, a hand strap 84 is provided on the bottom of the vacuum nozzle 72 which is substantially identical to the hand strap 32 utilized in the embodiment of the invention illustrated in FIGS. 1–3. In this construction, as illustrated in FIG. 5, the nozzle 72 includes downwardly diverging side walls 86 and a bottom wall 88 which is provided with a concave bottom surface 90 to conform with and follow the contour of the back of the hand 92. The hand strap 84 is arcuately curved with the upper surface thereof being concave as at 94 to also conform with the hand 92. Rather than the nozzle 72 being connected with a motor-fan unit as in FIGS. 1–3, it is provided with a tubular projecting nipple or fitting 96 integral with the rear wall 98 for connection with a vacuum hose 100 through a connecting adapter 102 so that, in effect, the nozzle 72 is removably and detachably connected to a fitting or adapter 102 on the vacuum hose 100. The vacuum hose 100 may be connected to a conventional floor supported vacuum cleaner or connected with a permanently installed wall or ceiling type vacuum system or connected to a vacuum cleaner that is supported from the person using the device such as a vacuum cleaner constructed in the form of a backpack that is supported by shoulder straps or the like or the vacuum cleaner may be supported from the person using the device in any suitable manner depending upon the size of the vacuum cleaner and the capability of the person using the deivce to support or carry the vacuum cleaner for long periods of time. The vacuum nozzle 72 may also be constructed of transparent plastic material and the nipple or fitting 96 may be smooth, provided with ridges, spiral threads or the like to facilitate connection with the coupler or connector 102 on the end of the vacuum hose 100. By using standard vacuum hose connector assemblies, the cost of the haircutting device may be kept at a minimum and the entire nozzle 72 and related structures may be of lightweight construction thus assuring that the hand 92 and other areas of the person using the device will not become unduly stressed or fatigued.

The present invention provides a lightweight, well balanced and easily manipulated haircutting device. The structure may be provided with different types of handles or attachment arrangements located so that the haircutting device will be well balanced and capable of being easily manipulated. The exact shape and configuration of the nozzle can be varied as to the tapered configuration and cross-sectional configuration with the inclined edge at the intake being preferably retained.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A haircutting device comprising an elongated hollow vacuum nozzle having an intake at one end thereof and means at the other end for reducing the pressure inside of the nozzle so that hair on a person's head will be drawn into the intake of the nozzle with the intake end of the nozzle forming a guide by which the hair can be cut by using a cutting implement, means on said nozzle for supporting engagement with a hand of the person using the device to enable the device to be manipulated in relation to the hair of a person receiving a haircut, and means adjustably supporting the intake end of the nozzle from the surface of the head in order to accurately position the intake end of the nozzle in spaced relation to the head, said supporting means including a ball rollingly engaging the surface of the head for movement of the nozzle in any direction while the intake end is supported in predetermined relation to the surface of the head, said means supporting the intake end of the nozzle including a depending boss on the nozzle, a right angular support rod having a horizontal portion extending through the boss and a depending vertical portion, a lock screw threaded into the boss for locking the support rod in adjusted position slidably and rotatably therein, a socket receiving said ball rotatably in the lower end thereof and including a tubular stem telescopically receiving the vertical portion of the support rod, and a lock screw threaded into the stem and locking the stem adjustably on the rod, and a graduated scale on the vertical portion of the support rod with the scale being associated with the top edge of the stem to indicate the height of the intake of the nozzle from the surface of the head.

2. The structure as defined in claim 1 wherein said nozzle includes a tubular adapter at the end thereof remote from the intake for connection with a flexible vacuum hose communicated with a source of vacuum.

3. The structure as defined in claim 1 wherein said nozzle includes an electrically powered fan-motor unit mounted on the end thereof remote from the intake to provide a vacuum in the nozzle.

4. The structure as defined in claim 1 wherein said nozzle is constructed of transparent plastic material and tapers to a smaller cross-sectional area at the intake end thereof.

5. The structure as defined in claim 1 wherein said means engageable with the hand of a user includes a hand strap integral with the bottom surface of the nozzle and adapted to receive a hand inserted between the hand strap and bottom surface of the nozzle.

6. The structure as defined in claim 5 wherein the bottom surface of the nozzle is provided with a downwardly facing concave contour and the hand strap curves downwardly therefrom with the bottom surface of the nozzle conforming with and engaging the back surface of the hand of the user with the fingers and thumb of the hand of the user being free for movement.

7. A device for aiding a person when cutting hair comprising an elongated hollow vacuum nozzle having an intake at one end thereof and means at the other end for reducing the pressure inside of the nozzle so that hair on a person's head will be drawn into the intake of the nozzle, said intake for the nozzle being formed by an inclined edge for generally paralleling the surface of the scalp on a person's head thereby forming a guide by which the hair can be cut by using a cutting implement, means on said nozzle for supporting engagement with a hand of the person using the device to enable the device to be manipulated in relation to the hair of a person receiving a haircut, and means adjustably supporting the intake end of the nozzle from the surface of the head in order to accurately position the intake end of the nozzle in spaced relation to the head, said supporting means including a support member movably engaging the surface of the head for movement of the nozzle in any direction while the intake end is supported in predetermined spaced relation to the head, said support member and nozzle including adjustment means enabling the support member to be adjusted laterally, longitudinally and vertically in relation to the nozzle, said support member including a single longitudinally adjustable member having a head engaging lower end engaging only a single area of the head and means connecting the upper end of the longitudinally adjustable member to the nozzle adjacent the intake enabling adjustment of the head engaging lower end laterally and longitudinally fore and aft in relation to the nozzle, said means on the nozzle for supporting engagement with a hand being spaced longitudinally from the support member to facilitate movement of the nozzle and the lower end of the longitudinally adjustable member omnidirectionally in relation to the head.

8. The device as defined in claim 7 wherein the lower end of said longitudinally adjustable member includes a downwardly opening socket and a ball journalled in said socket with the lower periphery thereof being exposed for engaging the surface of the scalp.

* * * * *